United States Patent [19]

Ohtsu et al.

[11] Patent Number: 4,853,588

[45] Date of Patent: Aug. 1, 1989

[54] DEFLECTION YOKE APPARATUS WITH MEANS FOR REDUCING UNWANTED RADIATION

[75] Inventors: Shinji Ohtsu, Tokyo; Haruyasu Yabushita, Kanagawa, both of Japan

[73] Assignee: Denki Onkyo Co., Ltd., Tokyo, Japan

[21] Appl. No.: 91,792

[22] Filed: Sep. 1, 1987

[30] Foreign Application Priority Data

| | | | |
|---|---|---|---|
| Sep. 5, 1986 | [JP] | Japan | 61-209147 |
| Oct. 17, 1986 | [JP] | Japan | 61-159332[U] |
| Mar. 27, 1987 | [JP] | Japan | 62-44261[U] |

[51] Int. Cl.[4] ..... H01F 7/00; H01J 29/46

[52] U.S. Cl. ..... 313/440; 315/8; 315/85; 335/213; 335/214

[58] Field of Search ..... 335/213, 214; 313/440; 315/8, 85

[56] References Cited

U.S. PATENT DOCUMENTS

| | | | |
|---|---|---|---|
| 3,019,361 | 1/1962 | DiPaolo | 335/214 |
| 4,386,331 | 5/1983 | Kohzuki et al. | 335/213 |
| 4,433,318 | 2/1984 | Okuyama et al. | 335/213 |
| 4,553,120 | 11/1985 | Dam | 335/210 |
| 4,587,504 | 5/1986 | Brown et al. | 335/301 |
| 4,636,684 | 1/1987 | Yokota et al. | 335/214 |
| 4,788,470 | 11/1988 | Kohzuki et al. | 335/213 |

FOREIGN PATENT DOCUMENTS

| | | |
|---|---|---|
| 220777 | 10/1986 | European Pat. Off. . |
| 3631023 | 3/1987 | Fed. Rep. of Germany . |
| 57-117300 | 7/1982 | Japan . |
| 62-64024 | 3/1987 | Japan . |
| 62-62751 | 4/1987 | Japan . |
| 62-93841 | 4/1987 | Japan . |
| 62-74743 | 5/1987 | Japan . |
| WO8706054 | 10/1987 | PCT Int'l Appl. . |

*Primary Examiner*—Donald J. Yusko
*Assistant Examiner*—Brian S. Palladino
*Attorney, Agent, or Firm*—Armstrong, Nikaido, Marmelstein, Kubovcik & Murray

[57] ABSTRACT

A deflection yoke apparatus comprises pairs of horizontal and vertical deflection coils. A coil separator is located between both coils. A deflection core forms a magnetic path for a magnetic flux generated from both deflection coils. An auxiliary coil is arranged at least a one position in a vertical deflection direction outside the deflection core. A horizontal deflection current is supplied to this auxiliary coil. A magnetic field, generated from the auxiliary coil, reduces an intensity of externally leaking magnetic field which radiates outside the deflection core when a horizontal deflection current is supplied to the horizontal deflection coils.

10 Claims, 6 Drawing Sheets

DEFLECTION YOKE APPARATUS WITH MEANS FOR REDUCING UNWANTED RADIATION

FIELD OF THE INVENTION

The present invention relates to a deflection yoke apparatus to be used in television equipment employing a cathode-ray tube, a particularly relates to a deflection yoke apparatus provided with one or more auxiliary coil devices for reducing the intensity of leaking magnetic field which is radiated outside the deflection yoke.

BACKGROUND OF THE INVENTION

As well known, cathode-ray tubes are widely used in various types of television equipment such as television receivers and television display units, and the deflection yoke is employed in each cathode-ray tube to deflect at least one electron beam.

The deflection yoke has a pair of horizontal deflection coils and a pair of vertical deflection coils. The horizontal deflection coils generate a horizontal deflection magnetic field to deflect at least one electron beam in the horizontal direction when a horizontal deflection current of approximately 15.75 kHz to 120 kHz is supplied. The vertical deflection coils generate a vertical deflection magnetic field to deflect at least one electron beam in the vertical direction when a vertical deflection current of 60Hz or 50Hz is supplied.

These deflection magnetic fields are distributed as a leaking magnetic field both inside and outside the deflection yoke. Of these magnetic fields, the leaking magnetic field generated inside the deflection yoke contributes to deflection of the electron beam and the attention has been paid to improvement of this internal magnetic field. On the other hand, the leaking magnetic field radiated outside the deflection yoke, that is, the externally leaking magnetic field, does not greatly affect the characteristics of the deflection yoke and the function of the deflection yoke is based on the utilization of the leaking magnetic field. Accordingly, up to now, measures to reduce the externally leaking magnetic field have rarely been taken.

Lately, various types of personal computers and electronically controlled office machines have been widely used at various offices and job shops where they are used in many cases in the vicinity of television equipment. Therefore, externally leaking magnetic fields of the deflection yoke, which had not been a problem, have a high frequency magnetic field generated from the horizontal deflection coils. The magnetic field has been considered to affect other electronic equipment as electromagnetic interference which causes these electronic equipment to malfunction.

For this reason, in some deflection yokes, a magnetism shielding cylinder which surrounds the deflection yoke is provided to reduce such electromagnetic interference.

However, provision of the magnetism shielding cylinder around the deflection yoke is disadvantageous in that a larger space will be required to result in a large size design of the housing of the television equipment. Also, the magnetism shielding cylinder forms the magnetic path for the externally leaking magnetic field to adversely affect landing and convergence of electron beams.

SUMMARY OF THE INVENTION

An object of the present invention is to provide a deflection yoke apparatus provided with one or more auxiliary coil devices, which reduces the externally leaking magnetic field generated from the deflection yoke.

Another object of the present invention is to provide a deflection yoke apparatus provided with one or more auxiliary coil devices, which reduces unwanted electromagnetic radiation generated from the deflection yoke without adverse effect on landing and convergence of electron beams in the television equipment employing the cathode-ray tube.

The deflection yoke apparatus of the present invention comprises a deflection core, a pair of horizontal deflection coils, a pair of vertical deflection coils, a coil separator located between these coils and auxiliary coil devices which are arranged at upper and lower positions or one of upper and lower positions in the Y-axis direction outside the deflection yoke when the horizontal deflection direction of electron beams is assigned as the X axis and the vertical deflection direction as the Y axis. The vertical deflection coils can be a saddle type coil or a toroidal type coil which is wound around the deflection coil.

The auxiliary coil device is generally made up by winding the auxiliary coil around the coil bobbin in a square form or winding it without the coil bobbin. The auxiliary coil device is arranged in the coil case. A magnetic member having high magnetic permeability is inserted into the center space of each auxiliary coil. The auxiliary coils can be made circular and bent in the circumferential direction of the deflection core. The auxiliary coils are connected in series or parallel to the horizontal deflection coils or connected to the horizontal deflection circuit to generate the canceling magnetic field which suppresses part of the externally leaking magnetic field radiated from the deflection core.

If the magnetic members are built in the auxiliary coil device, the canceling magnetic field is stronger than when no magnetic member is employed. If the auxiliary coil device is to be arranged only at one of positions in the Y-axis direction outside the deflection core, an adjustment such as increasing the number of turns of the auxiliary coils or increasing the current to be supplied to the auxiliary coils is required.

DETAILED DESCRIPTION OF THE INVENTION

Figure 1:
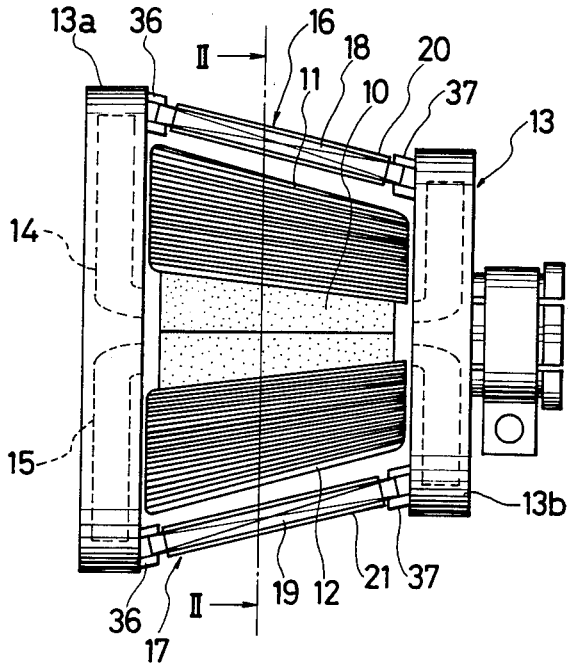
FIG. 1 is a side view of the deflection yoke apparatus provided with the auxiliary coils in accordance with the present invention.

In FIG. 1, the annular ferrite core 10 can be divided into two semi-annular half cores around each of which vertical deflection coils 11 and 12 are toroidal wound. Inside the deflection core 10, a pair of horizontal deflection coils 14 and 15 shown with the broken line are disposed with the coil separator 13 made of plastic resin material. On the exterior of the deflection core 10, auxiliary coil devices 16 and 17 are slantly arranged in the vertical direction on the drawing and respectively fixed to the engaging portion 36 provided on the front expanded part 13*a* and the engaging part 13*b* of the coil separator.

Figure 2:
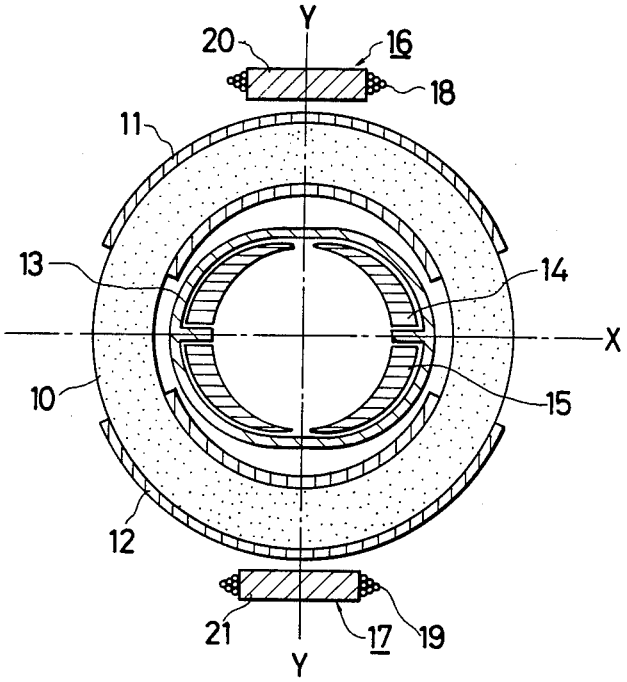
FIG. 2 is a sectional view along the one-dotted broken line II—II in FIG. 1.

FIG. 2 shows the sectional view along the broken line II—II in FIG. 1 and the deflection core 10 is located at the coordinate position where it is divided into four equal portions by X and Y axes. As viewed on this coordinate system, a pair of vertical deflection coils 11 and 12 are respectively arranged at upper and lower sides in reference to the X axis so that they are arranged symmetrically in reference to the Y axis. The auxiliary coil devices are located at the positions in the Y-axis direction equally away from the X axis and the parallel to the X axis.

Figure 3:
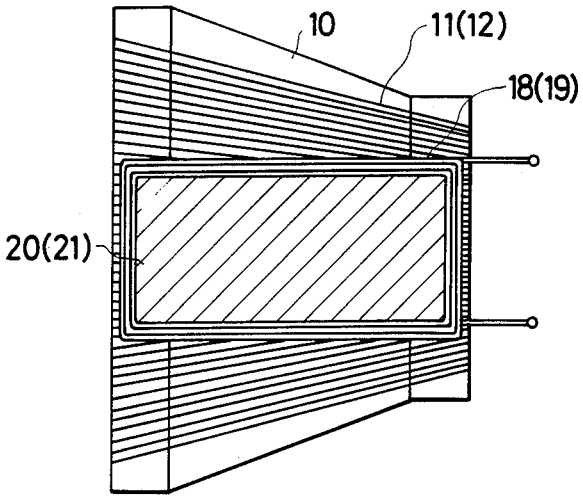
FIG. 3 is a simplified illustration to show the relative positions of the toroidal coils and the auxiliary coils in the deflection yoke apparatus in accordance with the present invention.
Figure 4:
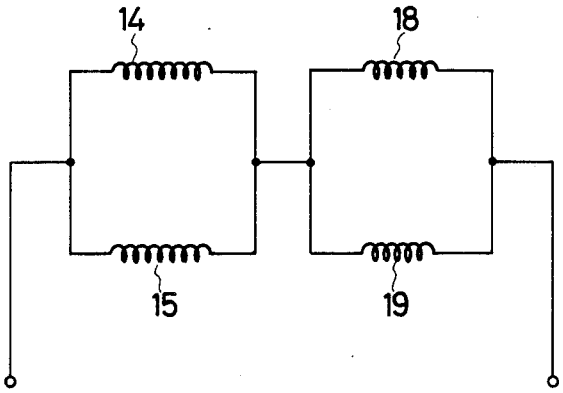
FIG. 4 shows an example of the connecting circuit for the horizontal deflection coils and the auxiliary coils, FIG. 5 briefly illustrates the operation of the deflection yoke apparatus in accordance with the present invention.

FIG. 3 shows the relationship between the deflection core 10 around which vertical deflection coils 11 and 12 are toroidally wound and the auxiliary coil devices 16 and 17. Auxiliary coils 18 and 19 are wound in a rectangular form and its length is almost equal to the length of the deflection core 10 in the axial direction of the core. Magnetic members 20 and 21 with high magnetic permeability made of ferrite, permalloy, silicon steel sheet or other material are inserted into the center hollow spaces or auxiliary coils 18 and 19 to intensify the magnitude of magnetic field generated when a current is supplied to the auxiliary coils. Auxiliary coils 18 and 19 are made up by winding seven times five 0.4 mm diameter copper wires which are stranded or bound, and these auxiliary coils are connected in series to horizontal deflection coils 14 and 15 as shown in FIG. 4. Accordingly, the current as large as the current flowing through the horizontal deflection coils is supplied to auxiliary coils 18 and 19.

Figure 5:
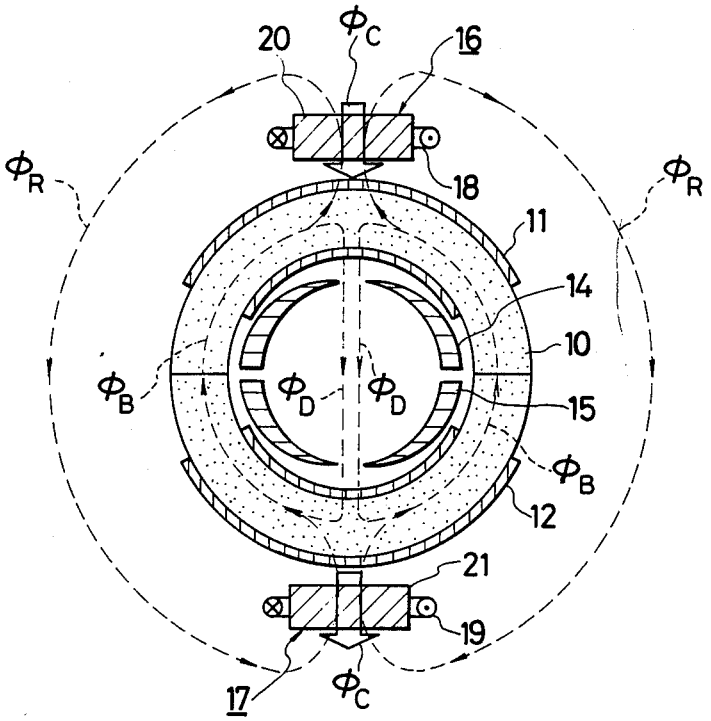

FIG. 5 shows the cross section of a part of the deflection yoke apparatus and briefly illustrates the state where the horizontal deflection current flows in horizontal deflection coils 14 and 15 and auxiliary coils 18 and 19. The arrowheads included in the broken line and the said line indicate an instantaneous state of the deflection cycle and the directions of the arrowheads are reversed when electron beams are deflected in the opposite direction. If it is assumed that magnetic flux $\phi B$ flows through the deflection core 10 when the horizontal deflection current is supplied to horizontal deflection coils 14 and 15, the magnetic flux $\phi D$ passes through the internal space of the deflection core 10 to contribute to deflection of electron beams and the remaining magnetic flux $\phi R$ passes through the external space of the deflection core 10. This magnetic flux $\phi R$ forms the externally leaking magnetic field which causes electromagnetic interference.

On the other hand, magnetic flux $\phi C$ generated from auxiliary coils 18 and 19 of auxiliary coil devices 16 and 17 has the direction opposite to that of magnetic flux $\phi R$ and forms the canceling magnetic field against the externally leaking magnetic field to suppress a part of the externally leaking magnetic field. In this case, since magnetic members 20 and 21 are inserted into auxiliary coils 18 and 19, the magnitude of the canceling magnetic field is increased by approximately 60% as compared with the auxiliary coils into which the magnetic members are not inserted. Accordingly, the number of turns of auxiliary coils 18 and 19 can be less. The use of magnetic members is determined according to the design of each type of the deflection yoke apparatus. The external sizes of auxiliary coils 18 and 19, number of turns of the coils, diameters of conductors used in these coils, etc. are determined taking into account the impedance of the horizontal deflection coils, magnitude of the externally leaking magnetic field, frequency of the current flowing through the coils 18 and 19, etc.

Figure 6:
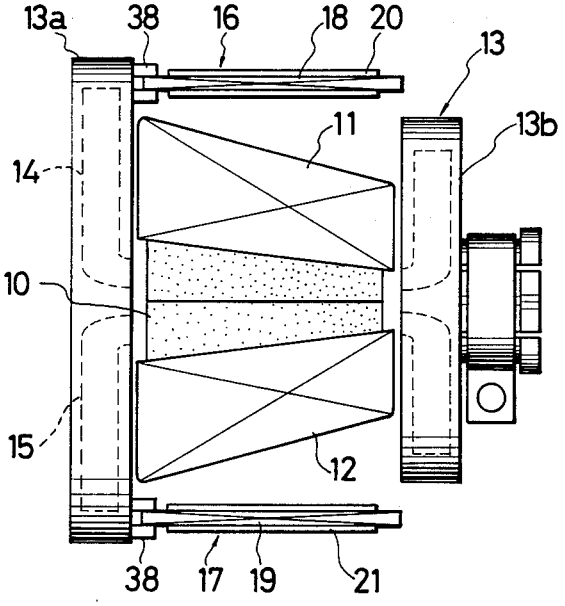
FIG. 6 is a side view showing another embodiment of the deflection yoke apparatus in accordance with the present invention.

FIG. 6 shows another embodiment of the deflection yoke apparatus in accordance with the present invention. Auxiliary coil devices 16 and 17 are fixed horizontally to the engaging portion 38 provided on the front expanded part 13*a* of the coil separator 13. In this case, auxiliary coil devices 16 and 17 can be easily fitted to the coil separator.

Figure 7:
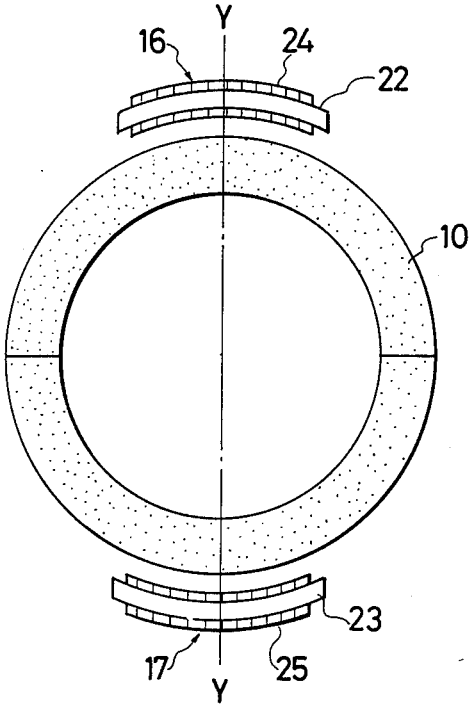
FIG. 7 shows the auxiliary coil which is bent.

FIG. 7 shows another embodiment of the auxiliary coil device. Auxiliary coils 22 and 23 are bent along the contour of the deflection core 10 and magnetic members 24 and 25 are bent accordingly. In this configuration, the magnetic resistance between magnetic members 24 and 25 and the deflection core 10 becomes uniform and the effect of the cancel magnetic field becomes large.

Figure 8:
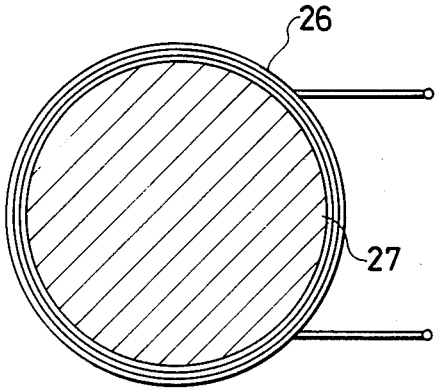
FIG. 8 is a plan view showing another embodiment of the auxiliary coil.

FIG. 8 shows another shape of the auxiliary coil device. The auxiliary coil 26 is formed to be circular and a disk-shaped member 27 is inserted. Though not shown, the auxiliary coil can be formed to be trapezoidal and the shape of the auxiliary coil can thus be freely determined in accordance with the shape of the deflection core.

Figure 9:
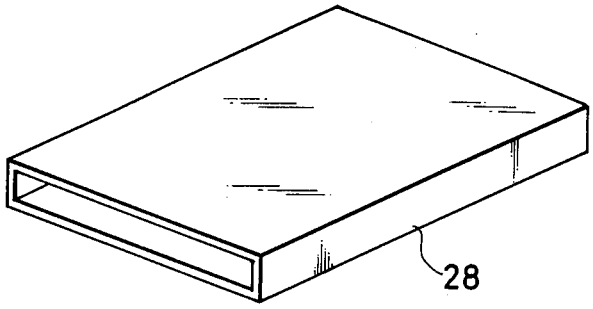
FIG. 9 shows an example of the case of the auxiliary coils.

Since the horizontal deflection current is supplied to the auxiliary coil, it is necessary to protect workers for assembling television equipment from electrical shock. For this purpose, the auxiliary coil device is made up by housing the auxiliary coils and magnetic members in the insulation case 28 made of a plastic material shown in FIG. 9.

FIG. 10 shows the more practically designed coil case for the auxiliary coil. The coil case 29 is rectangularly formed to have an internal square wall 29*a*, the external square wall 29*b* which is larger than the internal square wall 29*a* and a bottom 29C which exists between said internal and external square walls. The auxiliary coil is housed in the space formed by the internal wall 29*a*, external wall 29*b* and bottom 29*c*. The magnetic member is inserted and fixed in the center opening 30.

Figure 10A:
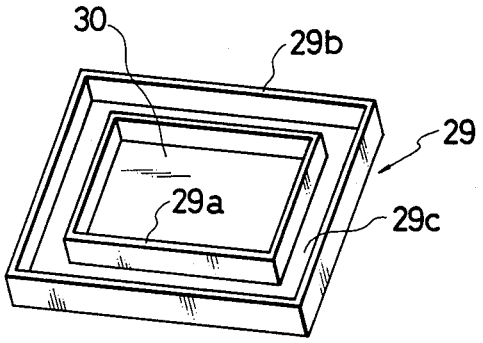
FIG. 10A shows another embodiment of the case of the auxiliary coil.
Figure 10B:
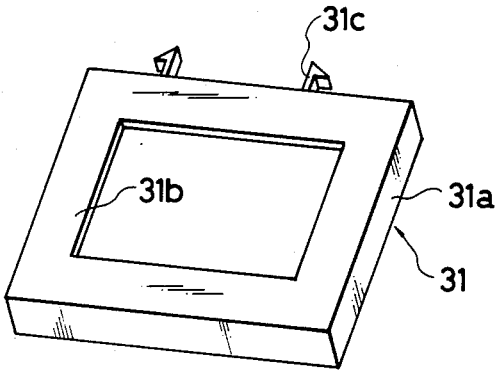
FIG. 10B shows an example of the case cover.

The coil case 29 is covered with the case cover 31 as shown in FIG. 10B. The case cover 31 has the edge wall 31*a* slightly larger than the contour of the external wall 29*b* of the coil case, top cover plate 31*b* for closing the auxiliary coil space of the coil case 29, and hook parts 31*c* for engaging with the engaging parts of the coil separator.

Figure 11:
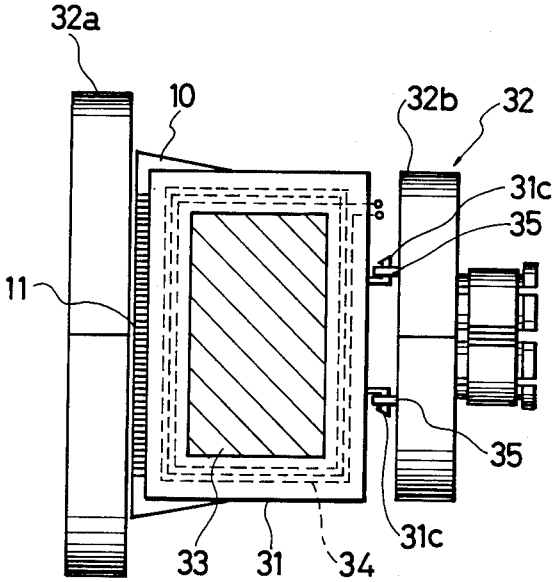
FIG. 11 shows another embodiment of the deflection yoke apparatus in accordance with the present invention in which the auxiliary coil device is fixed on the deflection yoke.

FIG. 11 shows an example of the auxiliary coil device which employs the coil case and the case cover shown in FIGS. 10A and 10B is fixed to the coil separator. The engaging parts 35 are provided at the rear expanded part 32*b* of the coil separator 32 and engaged with the hook parts 31*c*. In this case, the front expanded part 32*a* of the coil separator 32 does not have the engaging means for the auxiliary coil device 31 and the lower part of the auxiliary coil device is fixed with an adhesive agent such as for melt to the vertical deflection coil 11. The auxiliary coil device 31 has the auxiliary coil 34 and the magnetic member 33.

For strengthening connection of the auxiliary coil device 31 and the rear expanded wall 33*b*, the cover 31*b* is partly expanded in place of the hook part 31C and the expanded portion is directly fixed to the rear expanded wall 33*b*.

As described above, the deflection yoke apparatus in accordance with the present invention can reduce the externally leaking magnetic field having a high frequency radiated from the deflection coil, in other words, an unwanted radiation and minimize electromagnetic interference to other electronic equipment. The deflection yoke apparatus of the present invention can be modified in the design in the range of above-mentioned objects.

What is claimed is:

1. A deflection yoke apparatus, which is mounted on a neck of cathode-ray tube for projecting rasters on a screen by scanning at least one electron beam, said deflection yoke apparatus comprising:

a pair of horizontal deflection coils generating a magnetic field to deflect said electron beam in a horizontal direction;

a pair of vertical deflection coils generating a magnetic field to deflect said electron beam in a vertical direction;

a coil separator electrically insulating between both said vertical and horizontal deflection coils, said coil separator being provided with a front expanded part at a front end and a rear expanded part at a rear end;

an annular deflection core forming a magnetic path for a magnetic flux, generated when a deflection current is supplied to said horizontal and vertical deflection coils, a deflection magnetic field, for deflecting said electron beam inside said annular deflection core, and an externally leaking magnetic field outside said annular deflection core;

an auxiliary coil means being arranged at least at one of two positions in said vertical direction outside said deflection core, said auxiliary core means for generating a magnetic field with a direction opposite to a direction of said externally leaking magnetic field when a horizontal deflection current is supplied to said auxiliary core means; and an engaging means for fixing said auxiliary coil means to said coil separator.

2. A deflection yoke apparatus in accordance with claim 1, wherein said auxiliary coil means comprises a coil.

3. A deflection yoke apparatus in accordance with claim 1, wherein said auxiliary coil means has an auxiliary coil and a magnetic member made of soft magnetic material as a magnetic core for said coil.

4. A deflection yoke apparatus in accordance with claim 1, wherein said auxiliary coil means is provided with an auxiliary coil, a coil case for housing said coil and a case cover for covering said case.

5. A deflection yoke apparatus in accordance with claim 4, wherein said coil case is formed by an internal square wall, an external square wall and a bottom which couples said internal and external square walls.

6. A deflection yoke apparatus in accordance with claim 1, wherein said auxiliary coil means is provided at both positions in the vertical direction outside said deflection core.

7. A deflection yoke apparatus in accordance with claim 1, wherein said engaging means comprises engaging parts provided on at least one expanded part of said coil separator and hook parts provided on said auxiliary coil means.

8. A deflection yoke apparatus which is mounted on a neck of a cathode ray tube, said deflection yoke apparatus comprising:

a pair of horizontal deflection coils;

a pair of vertical deflection coils;

a coil separator for electrically insulating said horizontal and vertical deflection coils;

an annular deflection core forming a magnetic path for a magnetic flux generated by said horizontal and vertical deflection coils;

an auxiliary coil means for reducing an externally leaking magnetic field generated from said annular deflection core, said auxiliary coil means including an auxiliary coil connected to said horizontal deflection coils and a magnetic member inserted into a center hollow space of said auxiliary coil and arranged at two positions in said vertical direction outside said deflection core; and an engaging means for fixing said auxiliary coil means to said coil separator.

9. A deflection yoke apparatus in accordance with claim 8, wherein said magnetic member is formed in a rectangular and flat form.

10. A deflection yoke apparatus according to claim 1 wherein said auxiliary coil means includes a magnetic member inserted into a center of said auxiliary coil means.

* * * * *

UNITED STATES PATENT AND TRADEMARK OFFICE

CERTIFICATE OF CORRECTION

PATENT NO. : 4,853,588

DATED : August 1, 1989

INVENTOR(S) : OHTSU et al

It is certified that error appears in the above-identified patent and that said Letters Patent is hereby corrected as shown below:

On the cover page, Item [75], "both of Japan" should read --Yoshimitsu Takamatsu, Kanagawa, all of Japan--.

Signed and Sealed this

Twelfth Day of June, 1990

*Attest:*

HARRY F. MANBECK, JR.

*Attesting Officer*

*Commissioner of Patents and Trademarks*